US011913305B1

(12) United States Patent
Alvarez et al.

(10) Patent No.: US 11,913,305 B1
(45) Date of Patent: Feb. 27, 2024

(54) SEAL ARRANGEMENT, METHOD, AND SYSTEM

(71) Applicant: Baker Hughes Oilfield Operations LLC, Houston, TX (US)

(72) Inventors: Miguel Alvarez, San Miguel de Allende (MX); Joshua Raymond Snitkoff, Friendswood, TX (US); John Burris, Bixby, OK (US); Chad Yates, Houston, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 18/169,055

(22) Filed: Feb. 14, 2023

(51) Int. Cl.
*E21B 33/12* (2006.01)
*E21B 34/06* (2006.01)

(52) U.S. Cl.
CPC ..... *E21B 34/06* (2013.01); *E21B 33/1212* (2013.01); *E21B 2200/05* (2020.05)

(58) Field of Classification Search
CPC ... E21B 33/1212; E21B 34/06; E21B 2200/05
See application file for complete search history.

(56) References Cited

U.S. PATENT DOCUMENTS 3,489,170 A * 1/1970 Leman ..... F04B 53/1087 251/363
4,674,575 A * 6/1987 Guess ..... E21B 34/06 251/332
5,263,847 A * 11/1993 Akkerman ..... E21B 34/06 251/303
7,841,416 B2 * 11/2010 Henschel ..... E21B 34/10 166/386
9,726,300 B2 8/2017 Zhao et al.
9,745,822 B2 * 8/2017 Bernard ..... E21B 34/06
10,443,348 B2 * 10/2019 Williamson ..... E21B 34/00
2008/0169610 A1 * 7/2008 Curington ..... E21B 34/14 277/312
2009/0314979 A1 * 12/2009 McIntire ..... F04B 53/102 251/334

FOREIGN PATENT DOCUMENTS

GB 2553956 B 11/2019

* cited by examiner

*Primary Examiner* — Matthew R Buck

(74) *Attorney, Agent, or Firm* — CANTOR COLBURN LLP

(57) ABSTRACT

A seal arrangement includes a body having a face seal, and a flexible arm extending from the body. The arm includes a contact seal. A flapper valve, includes a housing, a flapper and a flapper seat. The flapper seat includes a body having a face seal positioned to make sealing contact with the flapper in selected flapper positions A method for sealing a flapper valve includes closing a flapper toward a seat and making a seal, by deflecting a flexible arm of the flapper seat that supports a contact seal. A borehole system including a borehole in a subsurface formation, a string in the borehole, and a seal arrangement disposed within or as a part of the string.

16 Claims, 5 Drawing Sheets

SEAL ARRANGEMENT, METHOD, AND SYSTEM

BACKGROUND

In the resource recovery and fluid sequestration industries, seals are often important of fluid control. The downhole environment is a very unfriendly environment for elastomeric seals. Although such seals are often used even with the harsh conditions, metal-to-metal seals are more robust and if a way for them to be used in various arrangements instead of elastomeric seals is invented, they are most welcome to the industry.

SUMMARY

An embodiment of a seal arrangement including a body having a face seal, and a flexible arm extending from the body, the arm including a contact seal.

An embodiment of a flapper seat comprising a seal arrangement.

An embodiment of a flapper valve, including a housing, a flapper articulated to the housing, a flapper seat receptive to the flapper in a flapper closed position, the flapper seat including a body having a face seal positioned to make sealing contact with the flapper in selected flapper positions, and a flexible arm extending from the body, the arm including a contact seal, positioned to make sealing contact with the flapper in selected flapper positions.

An embodiment of a method for sealing a flapper valve including closing a flapper of the flapper valve toward a seat of the flapper valve, contacting a contact seal of the flapper seat with the flapper and making a seal, deflecting a flexible arm of the flapper seat that supports the contact seal, and contacting a face seal of the flapper seat with the flapper.

An embodiment of a borehole system including a borehole in a subsurface formation, a string in the borehole, and a seal arrangement disposed within or as a part of the string.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
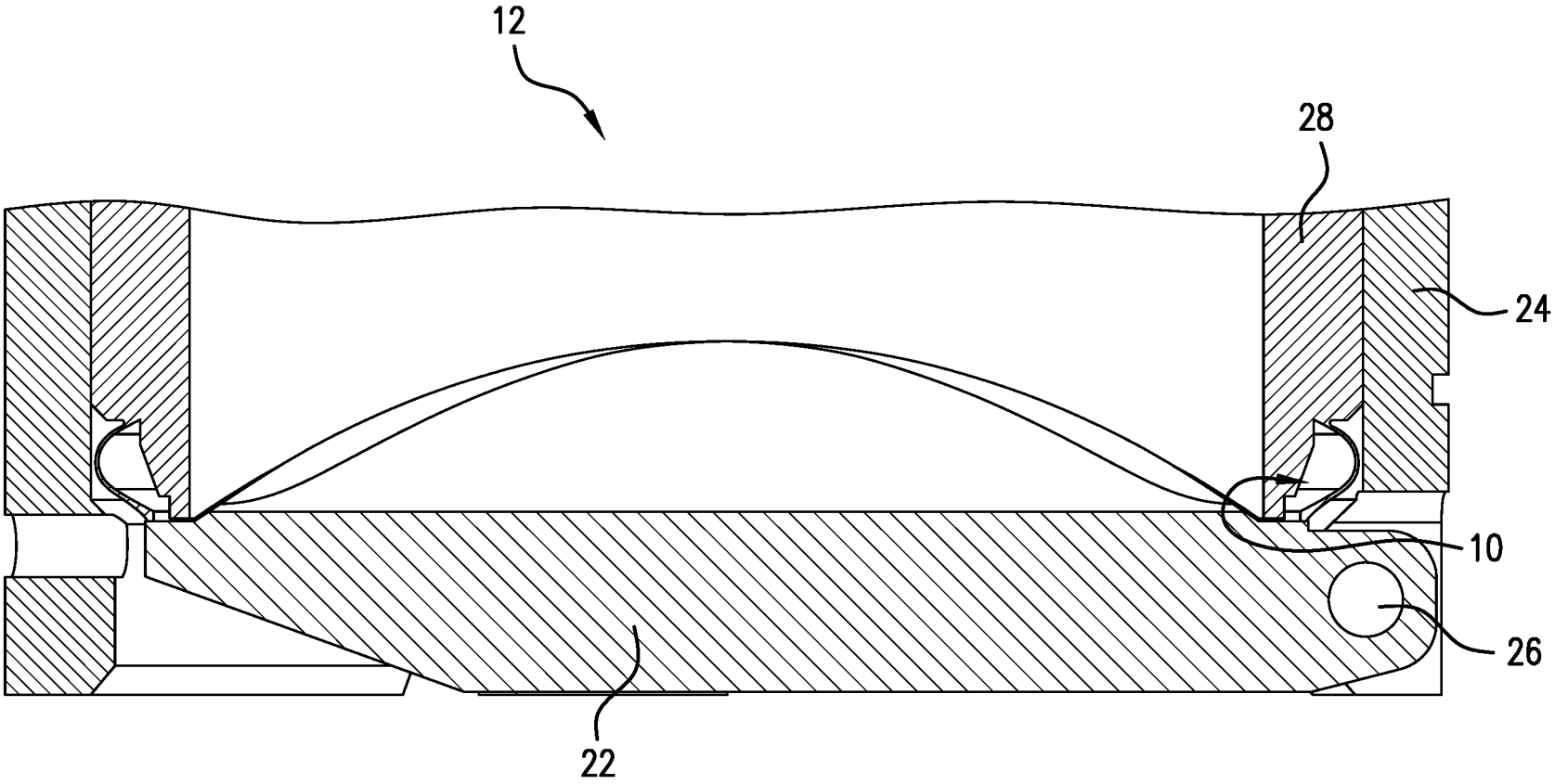
FIG. 1 is a section view illustrating a seal arrangement as described herein where the particular arrangement is used with a flapper valve.

Referring to FIG. 1, a seal arrangement 10 is illustrated in place within a flapper valve 12 as one example of the utility of the seal arrangement 10. It is to be understood that the seal arrangement 10 may be used with other tools as well with similar results. The arrangement 10, in some embodiments comprises both a higher pressure seal and a lower pressure seal, though it is also contemplated that the lower pressure seal be used on its own to substitute a metal-to-metal seal for a common elastomeric seal. The arrangement 10, in some embodiments comprises a body 14 having a face seal 16 and a flexible arm 18 extending form the body 14, the arm 14 having a contact seal 20 thereon. While the arrangement 10 is illustrated with the flexible arm 18 depending from the body 14, it is also contemplated that the flexible arm 18 may depend from a different structure yet still be positioned to flexibly create the seal at the contact seal 20, as in the illustration of FIG. 1, with a moving member 22. In the case of FIG. 1, the member 22 is illustrated as a flapper but it is to be understood that any member that can move into contact with the contact seal 20 or into contact with the contact seal may move by reversing which part moves, is contemplated. In embodiments, the flexible arm may be a portion of a toroid in shape. In each case, the flexible arm will have a geometry and material properties that allow it to remain in the elastic deformation range for the full range of motion of the arm during cycling between at rest and sealing positions. For example, materials such as stainless steels, low-carbon steels, low-alloy steels, Austenitic nickel-chromium-based superalloys are contemplated among others. With regard to geometry, thickness of the material of the flexible arm in some embodiments will be about .010 inch to about .020 inch.

For purposes of clarity, one of skill in the art will recognize the flapper valve 12 to includes a housing 24, to which the flapper 22 is pivotally mounted by a pin 26. The flapper 22 is interactive with a flapper seat 28 upon which the seal arrangement 10 is disposed. The seal arrangement 10 may be secured to the seat 28 or actually be a part thereof in some embodiments. The seal arrangement 10 may be subtractively, additively, or otherwise manufactured either as a separate component from the seat 28 or as a part thereof.

Figure 2:
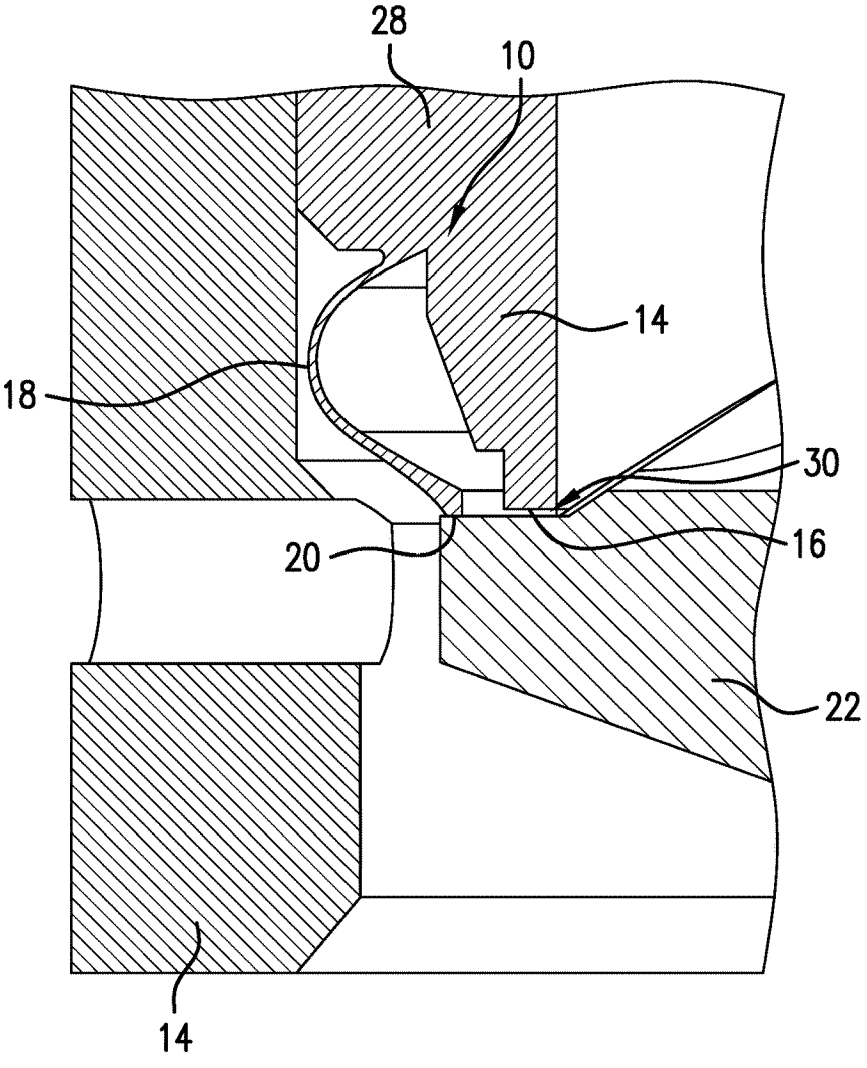
FIG. 2 is an enlarged view of a portion of FIG. 1, illustrating the seal arrangement in a lower pressure sealing position.

Referring to FIG. 2, the contact seal 20 is illustrated in a sealing relationship with flapper 22 while face seal 16 is not in contact with flapper 22. This is a lower pressure sealing position. Differential pressure across flapper 22 is in a lower range of, for example, up to about 200 pounds per square inch (PSI). Beyond 200 PSI, the face seal 16 would be engaged. At below about 200 PSI, there is insufficient pressure to cause flapper 22 to move into contact with the face seal 16. Nevertheless, a seal is made by contact seal 20. The flexible arm 18 provides seal energy to the contact seal 20 ensuring a fluid tight seal is created thereby against the flapper 22.

Figure 3:
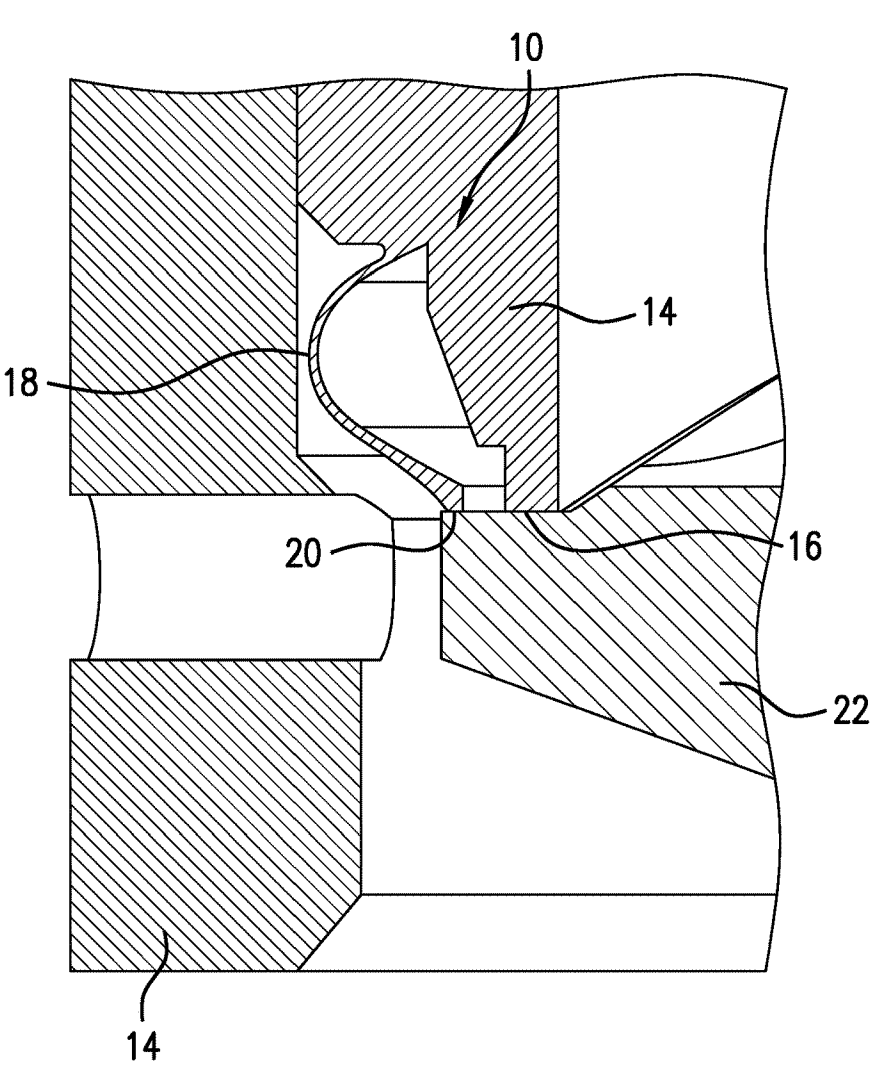
FIG. 3 is an enlarged view of a portion of FIG. 1, illustrating the seal arrangement in a higher pressure sealing position.

Referring to FIG. 3, a higher differential pressure has been applied to the flapper 22. In this higher differential pressure position, it will be appreciated the flapper 22 has been moved into contact with the face seal 16 and is now sealed therewith. In order to permit the flapper 22 to move into contact with the face seal 16, the flexible arm 18 must deflect and allow the closure of the gap 30 illustrated in FIG. 2 and missing in FIG. 3. It is important that the flexible arm 18 flex within elastic deformation rather than plastic deformation so that the contact seal 20 remains functional for subsequent opening and closing operations of the flapper valve 12 or other tool that uses the seal arrangement 10.

Figure 4:
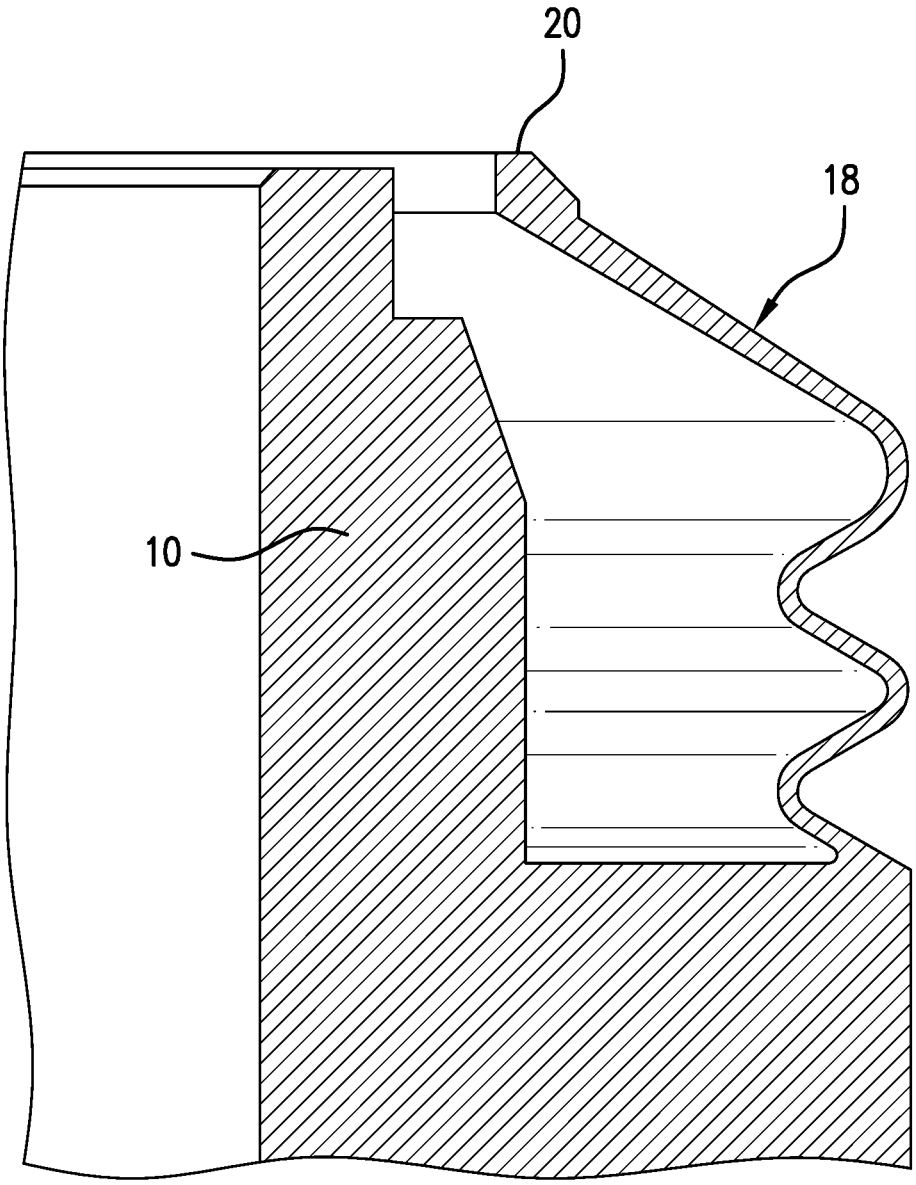
FIG. 4 is a section view of an alternative configuration of the seal arrangement disclosed herein.

Referring to FIG. 4, an alternative cross section for flexible arm 18 is illustrated. Function is identical. The number of wave forms is not limited other than by applicable space.

Figure 5:
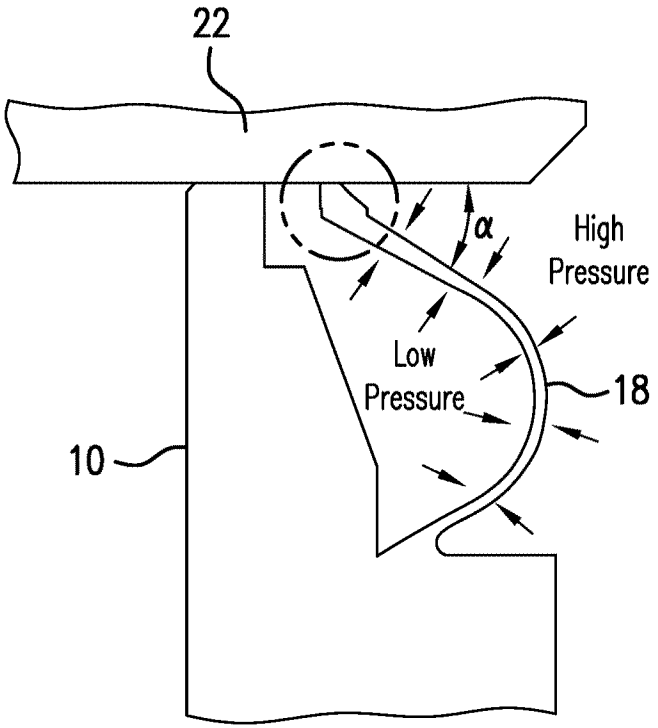
FIG. 5 is a schematic view illustrating pressure differential across the flexible arm as described herein.

Referring to FIG. 5, it is to be understood that when the seal arrangement 10 is in the lower pressure sealing position illustrated in FIG. 2, pressure of fluid radially inwardly of the flexible arm 18 and contact seal 20 will be the same as that outside of the flexible arm 18 and seal 20. When pressure increases however, causing the flapper to move to the position of higher-pressure sealing illustrated in FIG. 3, the pressure radially inwardly of the flexible arm 18 and contact seal 20 will be the same as the pressure when the contact seal 20 was first put into sealing contact with the flapper 22 (see FIG. 5 where "low pressure" is indicated). This is an undesirable condition for the flexible arm 18 as it may damage the arm 18. Accordingly, the arm 18 is configured in each of the illustrated embodiments to put the contact seal 20 into contact with the flapper 22 at an angle alpha of less than or equal to 90 degrees. This angle allows the contact seal 20 to "burp" pressure to the volume radially inwardly of the flexible arm 18 and contact seal 20 (i.e., the area marked "low pressure" in FIG. 5). This preserves function of the flexible arm 18. In one particular example, the angle alpha is about 30 degrees.

Figure 6:
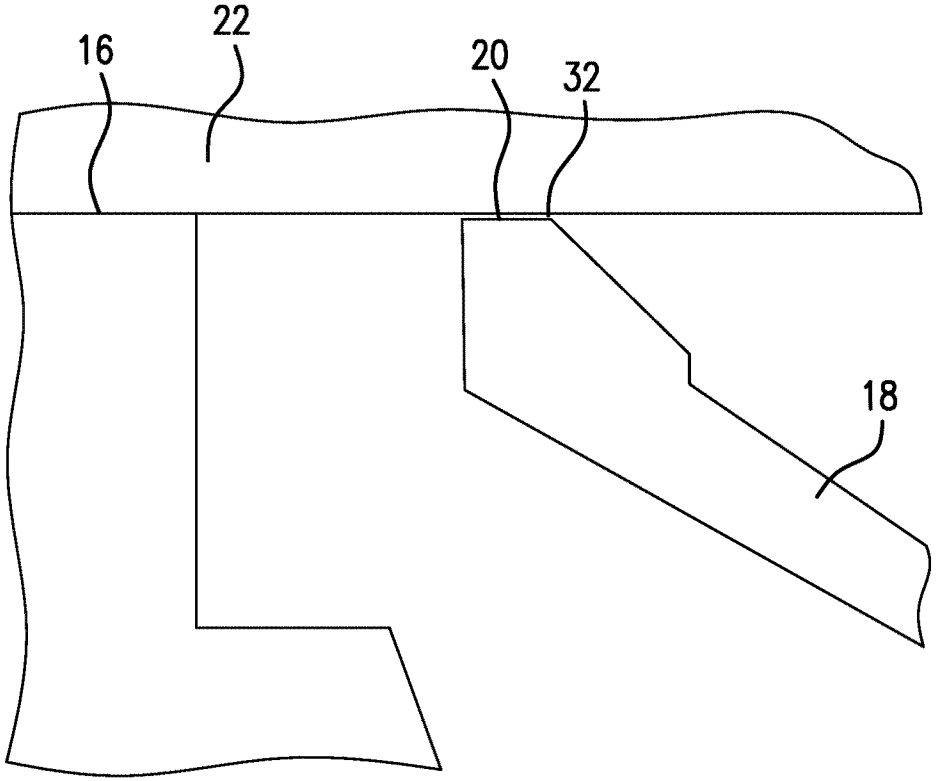
FIG. 6 is a further enlarged view of a portion of FIG. 5 to illustrate the contact seal.

Referring to FIG. 6, the enlarged view is intended to make clear that contact seal 20 is in some embodiments positioned to preferentially load one edge 32 of the contact seal 20 to increase contact pressure and enhance the seal created.

Figure 7:
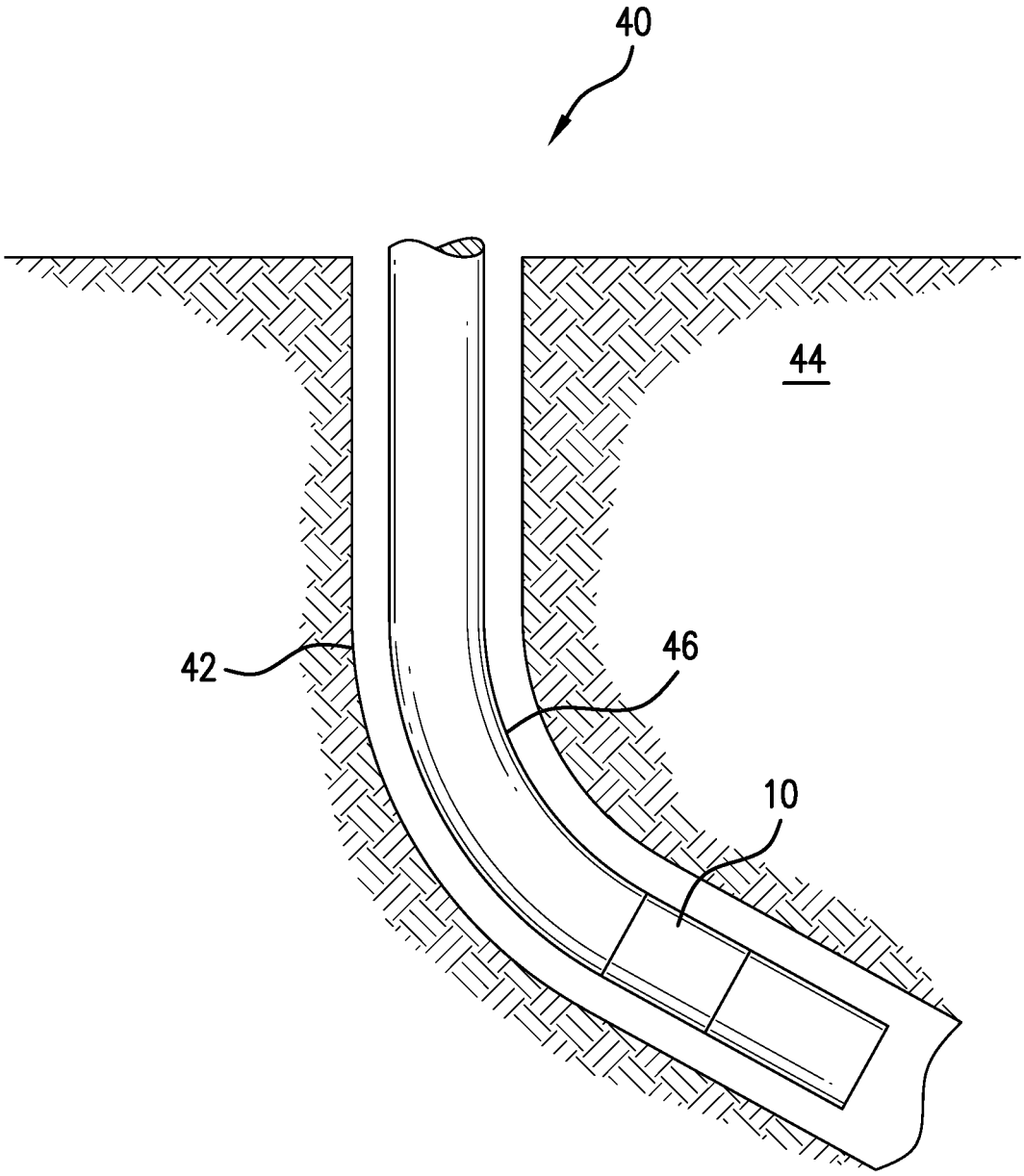
FIG. 7 is a view of a borehole system including the seal arrangement as disclosed herein.

Referring to FIG. 7, a borehole system 40 is illustrated. The system 40 comprises a borehole 42 in a subsurface formation 44. A string 46 is disposed within the borehole 42. A seal arrangement 10 is disposed within or as a part of the string 46.

Set forth below are some embodiments of the foregoing disclosure:

Embodiment 1: A seal arrangement including a body having a face seal, and a flexible arm extending from the body, the arm including a contact seal.

Embodiment 2: The arrangement as in any prior embodiment wherein the flexible arm is curved.

Embodiment 3: The arrangement as in any prior embodiment wherein the flexible arm is wavelike in cross section.

Embodiment 4: The arrangement as in any prior embodiment wherein the flexible arm is part toroidal.

Embodiment 5: The arrangement as in any prior embodiment wherein the contact seal includes a contact point that increases contact pressure against a structure to which it is sealed.

Embodiment 6: The arrangement as in any prior embodiment wherein the flexible arm is metal.

Embodiment 7: A flapper seat comprising a seal arrangement as in any prior embodiment.

Embodiment 8: A flapper valve, including a housing, a flapper articulated to the housing, a flapper seat receptive to the flapper in a flapper closed position, the flapper seat including a body having a face seal positioned to make sealing contact with the flapper in selected flapper positions, and a flexible arm extending from the body, the arm including a contact seal, positioned to make sealing contact with the flapper in selected flapper positions.

Embodiment 9: The valve as in any prior embodiment, wherein the contact seal makes sealing contact with the flapper during relatively lower differential pressure settings and the face seal makes sealing contact with the flapper during relatively higher differential pressure settings.

Embodiment 10: The valve as in any prior embodiment, wherein the contact seal makes sealing contact with the flapper at an angle of 90 degrees or less.

Embodiment 11: The valve as in any prior embodiment, wherein the contact seal makes sealing contact with the flapper before the face seal makes contact with the flapper during movement of the flapper toward a closed position.

Embodiment 12: The valve as in any prior embodiment, wherein the flexible arm energizes the contact seal when in contact with the flapper.

Embodiment 13: The valve as in any prior embodiment, wherein the contact seal is burpable to equalize pressure across the flexible arm.

Embodiment 14: The valve as in any prior embodiment, wherein the contact seal is metal.

Embodiment 15: The valve as in any prior embodiment, wherein the flexible arm is metal.

Embodiment 16: A method for sealing a flapper valve including closing a flapper of the flapper valve toward a seat of the flapper valve, contacting a contact seal of the flapper seat with the flapper and making a seal, deflecting a flexible arm of the flapper seat that supports the contact seal, and contacting a face seal of the flapper seat with the flapper.

Embodiment 17: The method as in any prior embodiment, further including equalizing pressure across the flexible arm.

Embodiment 18: The method as in any prior embodiment, wherein the equalizing is by burping the contact seal.

Embodiment 19: The method as in any prior embodiment, wherein the making a seal by contacting the contact seal with the flapper is making a metal-to-metal seal.

Embodiment 20: A borehole system including a borehole in a subsurface formation, a string in the borehole, and a seal arrangement as in any prior embodiment disposed within or as a part of the string.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" includes a range of ±8% of a given value.

The teachings of the present disclosure may be used in a variety of well operations. These operations may involve using one or more treatment agents to treat a formation, the fluids resident in a formation, a borehole, and/or equipment in the borehole, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A seal arrangement, comprising:

a body having a metal face seal; and a flexible metal arm extending arcuately from the body, the arm having a convex surface and a concave surface, the convex surface being radially outwardly disposed of the concave surface relative to the seal arrangement, the arm including a metal contact seal configured to make sealing contact with a structure, the arm configured to bow radially during sealing of the metal contact seal, the degree of bowing being limited to elastic deformation by contact of the metal face seal with the structure.

2. The arrangement as claimed in claim 1 wherein the flexible metal arm is configured to bow radially outwardly.

3. The arrangement as claimed in claim 1 wherein the flexible metal arm is wavelike in cross section.

4. The arrangement as claimed in claim 1 wherein the flexible metal arm is part toroidal.

5. The arrangement as claimed in claim 1 wherein the contact seal includes a contact point that increases contact pressure against a structure to which the contact point is sealed.

6. A flapper seat comprising a seal arrangement as claimed in claim 1.

7. A borehole system comprising:

a borehole in a subsurface formation;

a string in the borehole; and a seal arrangement as claimed in claim 1 disposed within or as a part of the string.

8. A flapper valve, comprising:

a housing;

a flapper articulated to the housing;

a flapper seat receptive to the flapper in a flapper closed position, the flapper seat including:

a body having a metal face seal positioned to make sealing contact with the flapper in selected flapper positions; and a flexible metal arm extending arcuately from the body, the arm having a convex surface and a concave surface, the convex surface being radially outwardly disposed of the concave surface relative to the seal arrangement, the arm including a metal contact seal, positioned to make metal-to-metal sealing contact with the flapper in selected flapper positions, the arm configured to bow radially during the metal-to-metal sealing contact, the degree of bowing being limited to elastic deformation by contact of the metal face seal with the flapper.

9. The valve as claimed in claim 8, wherein the metal contact seal makes sealing contact with the flapper during relatively lower differential pressure settings and the face seal makes sealing contact with the flapper during relatively higher differential pressure settings.

10. The valve as claimed in claim 8, wherein the metal contact seal makes sealing contact with the flapper with the flexible metal arm at an angle to the flapper of 90 degrees or less.

11. The valve as claimed in claim 8, wherein the metal contact seal makes sealing contact with the flapper before the metal face seal makes contact with the flapper during movement of the flapper toward the flapper closed position.

12. The valve as claimed in claim 8, wherein the flexible metal arm energizes the metal contact seal when in contact with the flapper.

13. The valve as claimed in claim 8, wherein the metal contact seal is burpable to equalize pressure across the flexible metal arm.

14. A method for sealing a flapper valve comprising:

closing a flapper of the flapper valve toward a seat of the flapper valve;

contacting a metal contact seal of the flapper seat with the flapper and making a metal-to-metal seal;

deflecting a flexible arcuate metal arm of the flapper seat that supports the metal contact seal, the arm having a convex surface and a concave surface, the convex surface being radially outwardly disposed of the concave surface; and contacting a metal face seal of the flapper seat with the flapper.

15. The method as claimed in claim 14, further including equalizing pressure across the flexible metal arm.

16. The method as claimed in claim 15, wherein the equalizing is by burping the metal contact seal.

* * * * *